US011933049B1

(12) United States Patent
Woodland et al.

(10) Patent No.: US 11,933,049 B1
(45) Date of Patent: Mar. 19, 2024

(54) ROOFING SYSTEM

(71) Applicants: Jason McSpadden Woodland, Pocatello, ID (US); Robert Dean Elzner, Pocatello, ID (US)

(72) Inventors: Jason McSpadden Woodland, Pocatello, ID (US); Robert Dean Elzner, Pocatello, ID (US)

( * ) Notice: Subject to any disclaimer, the term of this patent is extended or adjusted under 35 U.S.C. 154(b) by 152 days.

(21) Appl. No.: 17/313,916

(22) Filed: May 6, 2021

Related U.S. Application Data

(60) Provisional application No. 63/021,242, filed on May 7, 2020.

(51) Int. Cl.
*E04D 1/30* (2006.01)
*E04D 1/00* (2006.01)

(52) U.S. Cl.
CPC ..... *E04D 1/30* (2013.01); *E04D 1/2916* (2019.08); *E04D 2001/302* (2013.01); *E04D 2001/305* (2013.01)

(58) Field of Classification Search
CPC ... E04D 1/30; E04D 1/2916; E04D 2001/302; E04D 2001/305
See application file for complete search history.

(56) References Cited

U.S. PATENT DOCUMENTS 1,975,304 A 10/1934 Walter
2,133,683 A * 10/1938 Edward ..... E04D 3/38 206/323
2,568,603 A 9/1951 Anthony
3,264,790 A * 8/1966 Beals ..... E04D 3/40 52/287.1
3,783,570 A 1/1974 Storch
4,096,671 A * 6/1978 Aarons ..... E04D 13/064 52/542
4,226,070 A * 10/1980 Aragon ..... E04D 1/265 D25/140
4,888,932 A * 12/1989 Beare ..... E04D 3/40 52/748.1
5,048,255 A * 9/1991 Gonzales ..... E04D 1/08 52/537
5,533,313 A * 7/1996 Pike ..... E04D 1/34 52/712
5,636,481 A 6/1997 De Zen
5,722,212 A 3/1998 Struve
5,743,059 A 4/1998 Fifield
5,895,536 A 4/1999 Starr
6,125,592 A 10/2000 Hickey
(Continued)

*Primary Examiner* — Babajide A Demuren
(74) *Attorney, Agent, or Firm* — Bryant J. Keller; Kirton McConkie

(57) ABSTRACT

A roofing system for protecting a building comprises a plurality of side-interlocking and front-to-back interlocking roof panels. A top side includes a front flange projecting forward at a front end. One or more gutter panels may be included, each having a top side open to a U-shaped gutter. An interior of each roof panel and gutter panel includes an insulating foam material, and an outer surface includes a rigid shell. The gutter panel is adapted for fixing along an edge of the roof at least partially under the flange of any of the roof panels that are disposed along an edge of the roof. Preferably the roofing system further includes gable cap panels, soffit fascia panels, valley cap panels, and wind breakers for holding the roof panels down to the roof in wind.

20 Claims, 7 Drawing Sheets

(56) References Cited

U.S. PATENT DOCUMENTS

| | | | | |
|---|---|---|---|---|
| 6,193,826 | B1 | 2/2001 | Starr | |
| 6,206,991 | B1 | 3/2001 | Starr | |
| 6,314,700 | B2 | 11/2001 | Starr | |
| 6,955,019 | B2 | 10/2005 | Donlin | |
| 7,249,443 | B2 | 7/2007 | Faulkner | |
| 8,087,206 | B1 | 1/2012 | Worley | |
| 9,200,450 | B2 | 12/2015 | Thagard, III | |
| 9,267,296 | B2 | 2/2016 | Maurer | |
| 9,624,669 | B2 | 4/2017 | Torres | |
| 9,689,164 | B2 | 6/2017 | Rasmussen | |
| 10,087,631 | B2 | 10/2018 | Torres | |
| 10,138,631 | B2 | 11/2018 | Schmidt | |
| 10,280,624 | B2 | 5/2019 | Lucas | |
| 2003/0089064 | A1 | 5/2003 | Faulkner | |
| 2005/0183345 | A1* | 8/2005 | Allen | E04D 13/1478 52/58 |
| 2005/0252140 | A1 | 11/2005 | Faulkner | |
| 2007/0107358 | A1 | 5/2007 | Stone | |
| 2008/0053004 | A1* | 3/2008 | Oberoi | E04D 3/358 52/43 |
| 2008/0098672 | A1* | 5/2008 | O'Hagin | E04D 1/30 52/90.2 |
| 2008/0302025 | A1 | 12/2008 | Schriever | |
| 2009/0031660 | A1 | 2/2009 | Faulkner | |
| 2010/0269440 | A1* | 10/2010 | Torres | E04D 1/10 427/403 |
| 2011/0146199 | A1* | 6/2011 | Ferrante | E04D 12/004 52/745.06 |
| 2012/0272592 | A1 | 11/2012 | Bellavia | |
| 2015/0089887 | A1 | 4/2015 | Bellavia | |
| 2015/0152641 | A1* | 6/2015 | Torres | E04D 1/34 428/319.3 |
| 2018/0347194 | A1 | 12/2018 | Champion | |
| 2020/0256056 | A1 | 8/2020 | Kamphuis | |

* cited by examiner

ROOFING SYSTEM

CROSS-REFERENCE TO RELATED APPLICATIONS

This application claims the benefit of U.S. Provisional Patent Application 63/021,242, filed on May 7, 2020, and is incorporated herein by reference.

STATEMENT REGARDING FEDERALLY SPONSORED RESEARCH AND DEVELOPMENT

Not Applicable.

FIELD OF THE INVENTION

This invention relates to construction, and more particularly to building roofing systems.

BACKGROUND

Insulating an attic of a building is time consuming and costly since it involves insulating an underside of the roof with suspended insulation material. Further, roofing materials like cement or clay roof tiles and be expensive, difficult to work with due to their weight, and dangerous if inadvertently dropped on someone below.

Therefore, there is a need for a roofing system that insulated the attic space while simultaneously providing a light-weight roofing panel system. Such a needed invention would provide a variety of different types of roof panels and gutters, and would be easily installed with screws. Such a needed invention would include light-weight panels that are safer than cement or clay tiles, and that are easier to lift to the roof and manipulate during installation. The present invention accomplishes these objectives.

SUMMARY OF THE INVENTION

The present device is a roofing system for protecting a building of the type having a plurality of walls terminating at top ends thereof at a roof. The roofing system comprises three or more roof panels each having a front end, a back end, a left side with a left-side interlocking structure, a right side with a right-side interlocking structure, a top, and a bottom. The top includes a front flange projecting forward at the front end. An interior of the roof panel includes an insulating foam material. An outer surface of each roof panel includes a rigid shell, such as a stucco, plaster, cement, or other type of rigid shell. In some embodiments the roof panels and the flange each include a wavy top surface. Preferably the top of each roof panel is sloped from the front end to the back end with respect to the bottom, such that the bottom of each roof panel substantially contacts the roof and so that the flange can overlap the back end of the roof panel abutting its front end.

In use, with the first roof panel covering a portion of the roof, and with the front end of a second roof panel abutting the back end of the first roof panel, the front flange of the second roof panel overlaps the top of the first roof panel proximate the back end thereof. With the left side of a third roof panel abutting the right side of the first roof panel, the left-side interlocking structure of the third roof panel interlocks with and overlaps the right-side interlocking structure of the first roof panel.

Preferably the roofing system further includes one or more gutter panels each having an inner side, an outer side, two opposing ends, a top side open to a U-shaped gutter, and a bottom side. An interior of each gutter panel includes the insulating foam material. An outer surface of each gutter panel includes a rigid shell. The gutter panel is adapted for fixing along an edge of the roof at the inner side thereof and at least partially under the flange of any of the roof panels that are disposed along the edge of the roof. In this way water running down the roof panels is captured in the U-shaped gutter.

Preferably each gutter panel further includes a mounting slot traversing the inner side and adapted to receive a gutter support board therein. The gutter support board is fixed with the roof, providing a stable mounting surface and support for the gutter panel. Also, preferably the U-shaped gutter of each gutter panel is lined with a water-impervious roofing membrane that protrudes from at least one of the opposing ends of the gutter panel so that the roofing membranes of two adjacent gutter panels overlap and can be mutually adhered to inhibit water leakage from either of the two gutter panels.

In such embodiments preferably the roofing system further includes at least one inside corner gutter panel adapted to connect two of the gutter panels oriented-degrees apart on an inside corner of the roof, and at least one outside corner gutter panel adapted to connect two of the gutter panels oriented-degrees apart on an inside corner of the roof.

At least one of the gutter panels includes a downspout aperture traversing the water-impervious roofing membrane of the gutter through to the bottom side. The downspout aperture is adapted for connecting with a downspout conduit for conveying water collected in the gutter panels away from the building.

Preferably the roofing system further includes one or more gable cap panels adapted for fixing over either the left side or right side of roof panels that are disposed along a sloping edge of the roof. A cable cap trim panel may also be included to cover the edge of the roof. Further, a soffit fascia panel may be fixed under and along the sloping edge of the roof. Wind breakers may be further included for holding the roof panels down to the roof when the roof experiences a strong wind, for example. And still further, a wall flashing shoe may be included in the roofing system for water proofing the roof adjacent a building wall projecting upwardly from the roof.

Preferably the roofing system further includes one or more valley cap panels adapted for fixing over either the left side, right side, for front end of roof panels that are disposed along an edge of a valley of the roof. A cable cap trim panel may also be included to cover the edge of the roof. Each valley cap panel is adapted for allowing water to pass thereunder into the valley of the roof. Preferably a water-impervious membrane is fixed between adjacent valley caps at a valley of the roof.

The present invention is a roofing system that insulated the attic space while simultaneously providing a light-weight roofing panel system. The present invention provides a variety of different types of roof panels and gutters, each of which is easily installed with screws. The present system includes light-weight panels that are safer than cement or clay tiles, and that are easier to lift to the roof and manipulate during installation. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
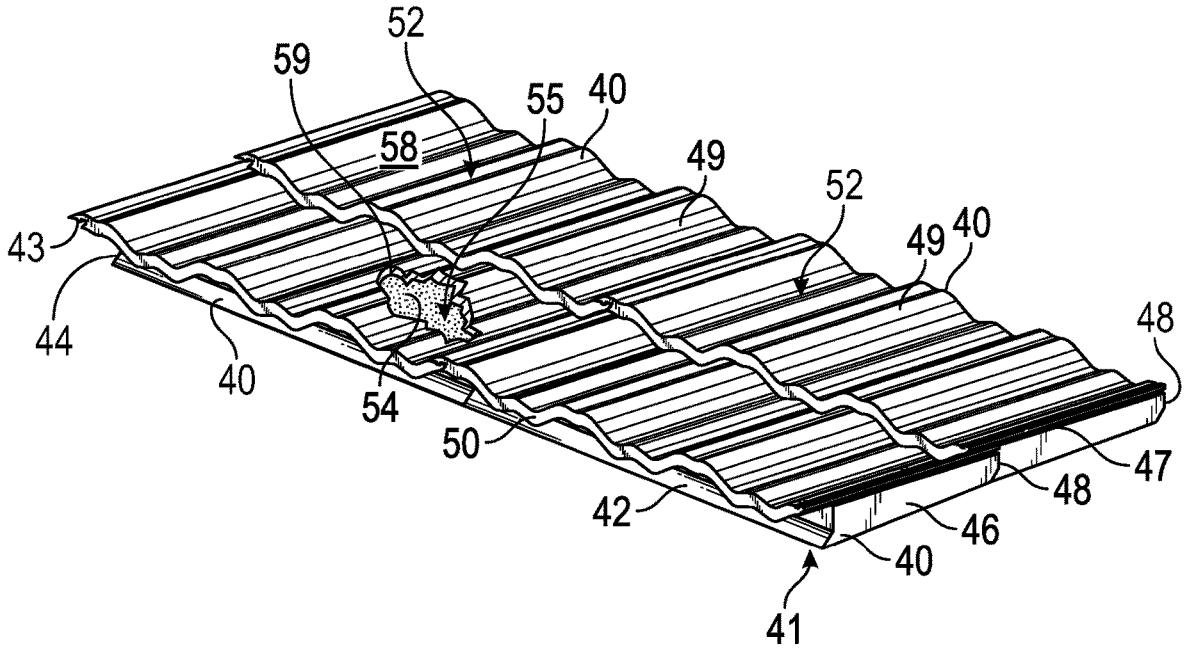
FIG. 1 is a perspective view of the invention, showing four interlocking roof panels.
Figure 2:
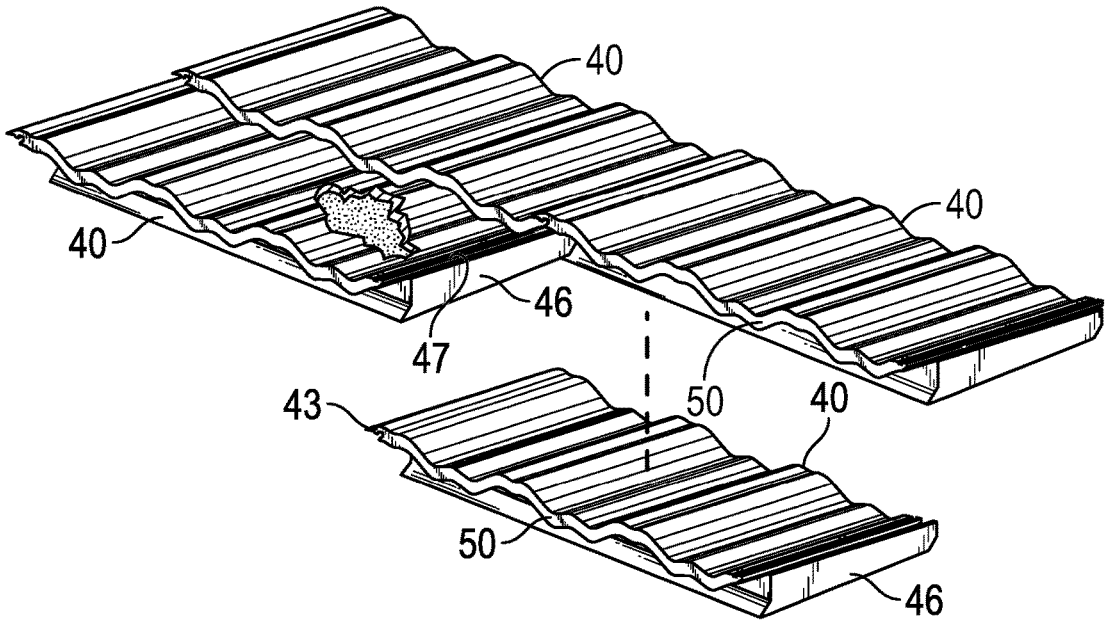
FIG. 2 is a perspective view of FIG. 1, showing one of the roof panels exploded away from the other three roof panels.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-5 illustrate a roofing system 10 for protecting a building 20 of the type having a plurality of walls 25 terminating at top ends 28 thereof at a roof 30.

The roofing system comprises three or more roof panels 40 each having a front end 42, a back end 48, a left side 44 with a left-side interlocking structure 43, a right side 46 with a right-side interlocking structure 478, a top 49, and a bottom 41. The top 49 includes a front flange 50 projecting forward at the front end 42. An interior 55 of the roof panel 40 includes an insulating foam material 54. An outer surface 58 of each roof panel 40 includes a rigid shell 59, such as a stucco, plaster, cement, or other type of rigid shell 59. In some embodiments the roof panels 40 and the flange 50 each include a wavy top surface 57. Preferably the top 49 of each roof panel 40 is sloped from the front end 42 to the back end 48 with respect to the bottom 41, such that the bottom 41 of each roof panel 40 substantially contacts the roof 30 (FIG. 4) and so that the flange 50 can overlap the back end 48 of the roof panel abutting its front end 42.

Figure 3:
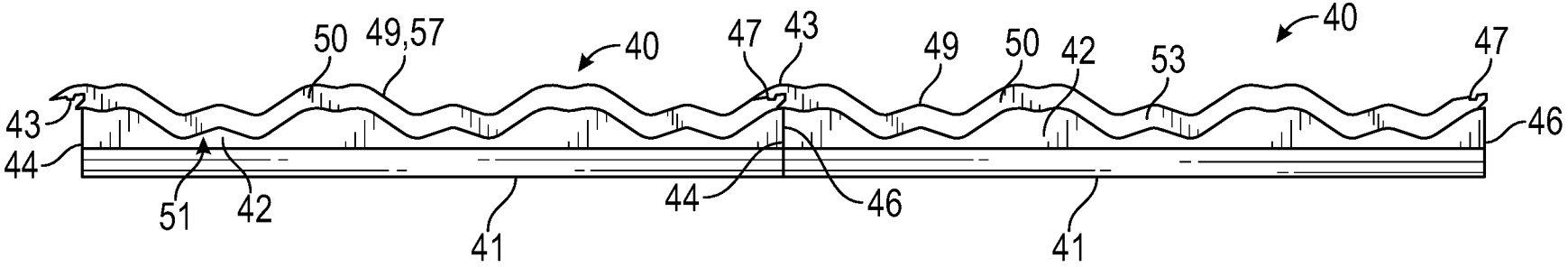
FIG. 3 is a front elevational view of FIG. 1.
Figure 4:
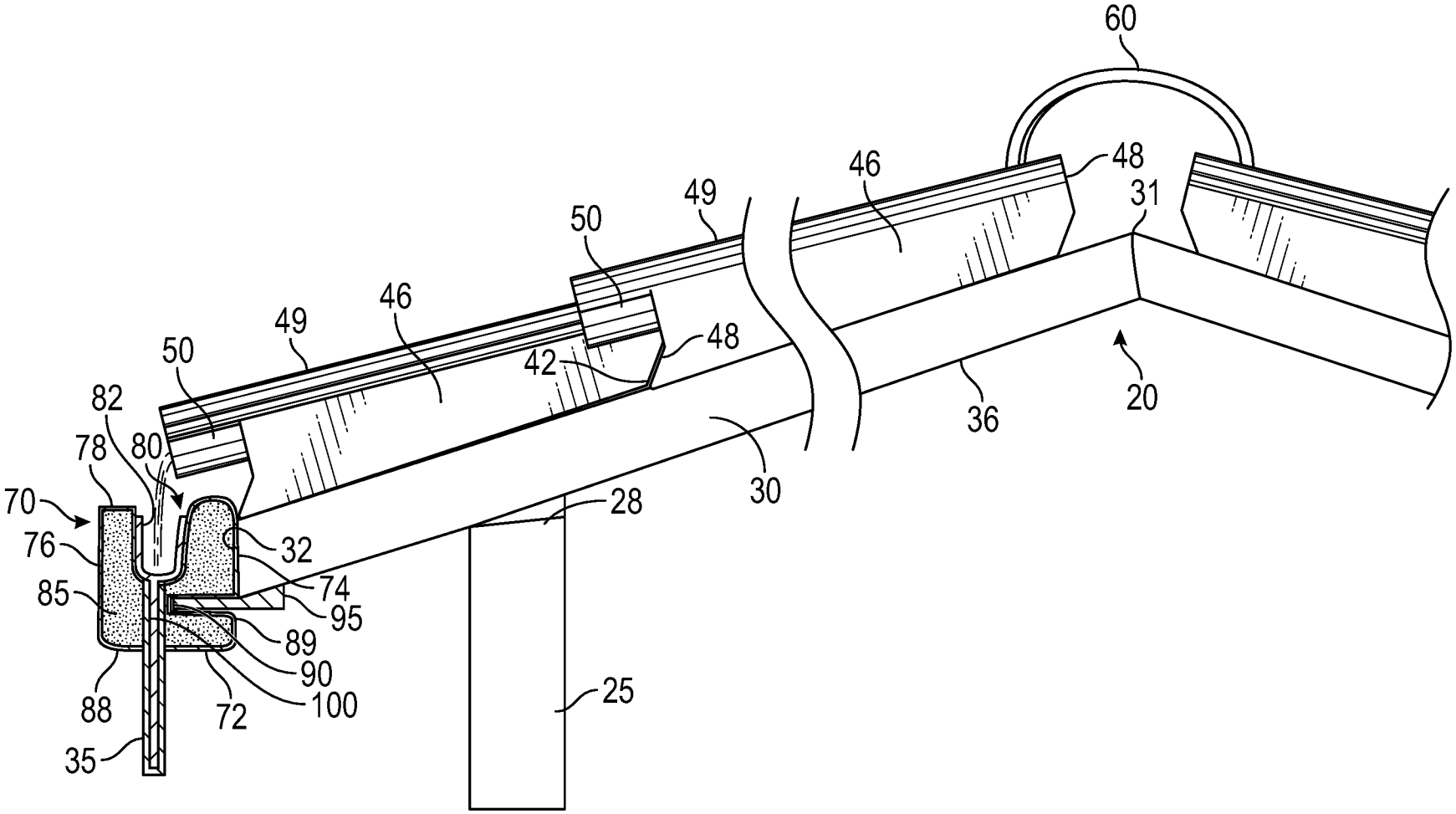
FIG. 4 is a side elevational view of the invention, further including a gutter panel.

In use, with the first roof panel 51 covering a portion of the roof 30, and with the front end 42 of a second roof panel 52 abutting the back end 48 of the first roof panel 51, the front flange 50 of the second roof panel 52 overlaps the top 49 of the first roof panel 51 proximate the back end 48 thereof. With the left side 44 of a third roof panel 53 abutting the right side 46 of the first roof panel 51, the left-side interlocking structure 43 of the third roof panel 53 interlocks with and overlaps the right-side interlocking structure 47 of the first roof panel 51 (FIG. 3).

Preferably the roofing system 10 further includes one ore more gutter panels 70 (FIGS. 4 and 5) each having an inner side 74, an outer side 76, two opposing ends 75, a top side 78 open to a U-shaped gutter 80, and a bottom side 72. An interior 85 of each gutter panel 70 includes the insulating foam material 54. An outer surface 88 of each gutter panel 70 includes a rigid shell 89. The gutter panel 70 is adapted for fixing along an edge 32 of the roof 30 at the inner side 74 thereof and at least partially under the flange 50 of any of the roof panels 40 that are disposed along the edge 32 of the roof 30. In this way water running down the roof panels 40 is captured in the U-shaped gutter 80. Preferably each gutter panel 70 further includes a mounting slot 90 traversing the inner side 74 and adapted to receive a gutter support board 95 therein. The gutter support board 95 is fixed with the roof 30, providing a stable mounting surface and support for the gutter panel 70. Also, preferably the U-shaped gutter 80 of each gutter panel 70 is lined with a water-impervious roofing membrane 82, such as single-ply thermoplastic polyolefin (TPO), that protrudes from at least one of the opposing ends 75 of the gutter panel 70 so that the roofing membranes 82 of two adjacent gutter panels 70 overlap and can be mutually adhered to inhibit water leakage from either of the two gutter panels 70.

Figure 9A:
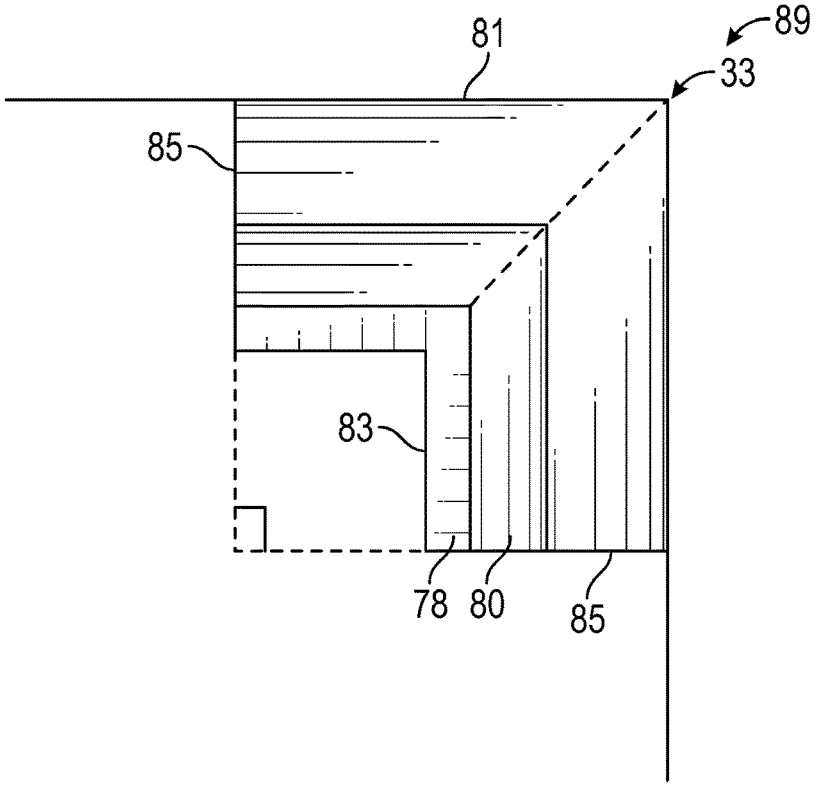
FIG. 9A is a top plan view of an inside corner of a roof and an inside corner gutter panel.

In such embodiments preferably the roofing system 10 further includes at least one inside corner gutter panel 84 (FIG. 9A) adapted to connect two of the gutter panels 70 oriented 90-degrees apart on an inside corner 33 of the roof 30. Each inside corner gutter panel 84 includes two ends 85 facing 90-degrees apart from each other. Such an inside corner gutter panel 84 has inner sides 81 that have a longer perimeter than the outer sides 83 thereof.

Figure 9B:
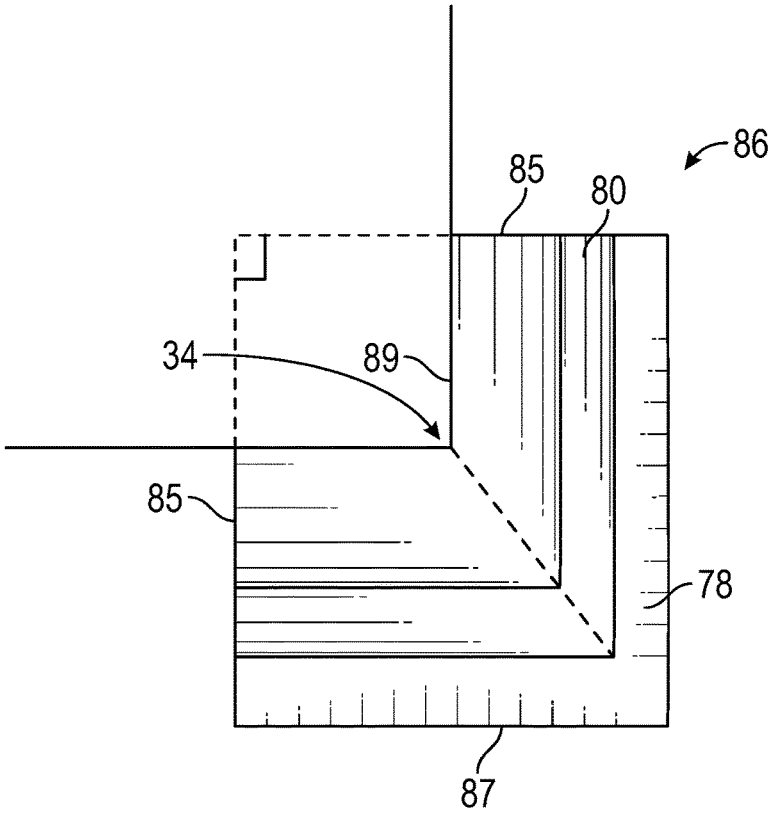
FIG. 9B is a top plan view of an outside corner of a roof and an outside corner gutter panel.

Similarly, the roofing system 10 further includes at least one outside corner gutter panel 86 (FIG. 9B) adapted to connect two of the gutter panels 70 oriented 90-degrees apart on an outside corner 34 of the roof 30. Each outside corner gutter panel 86 includes two ends 85 facing 90-degrees apart from each other. Such an outside corner gutter panel 86 has outer sides 87 that have a longer perimeter than inner sides 89 thereof.

At least one of the gutter panels 70 includes a downspout aperture 100 traversing the water-impervious roofing membrane 82 of the gutter 80 through to the bottom side 72. The downspout aperture 100 is adapted for connecting with a downspout conduit 35 for conveying water collected in the gutter panels 70 away from the building 20.

Figure 5:
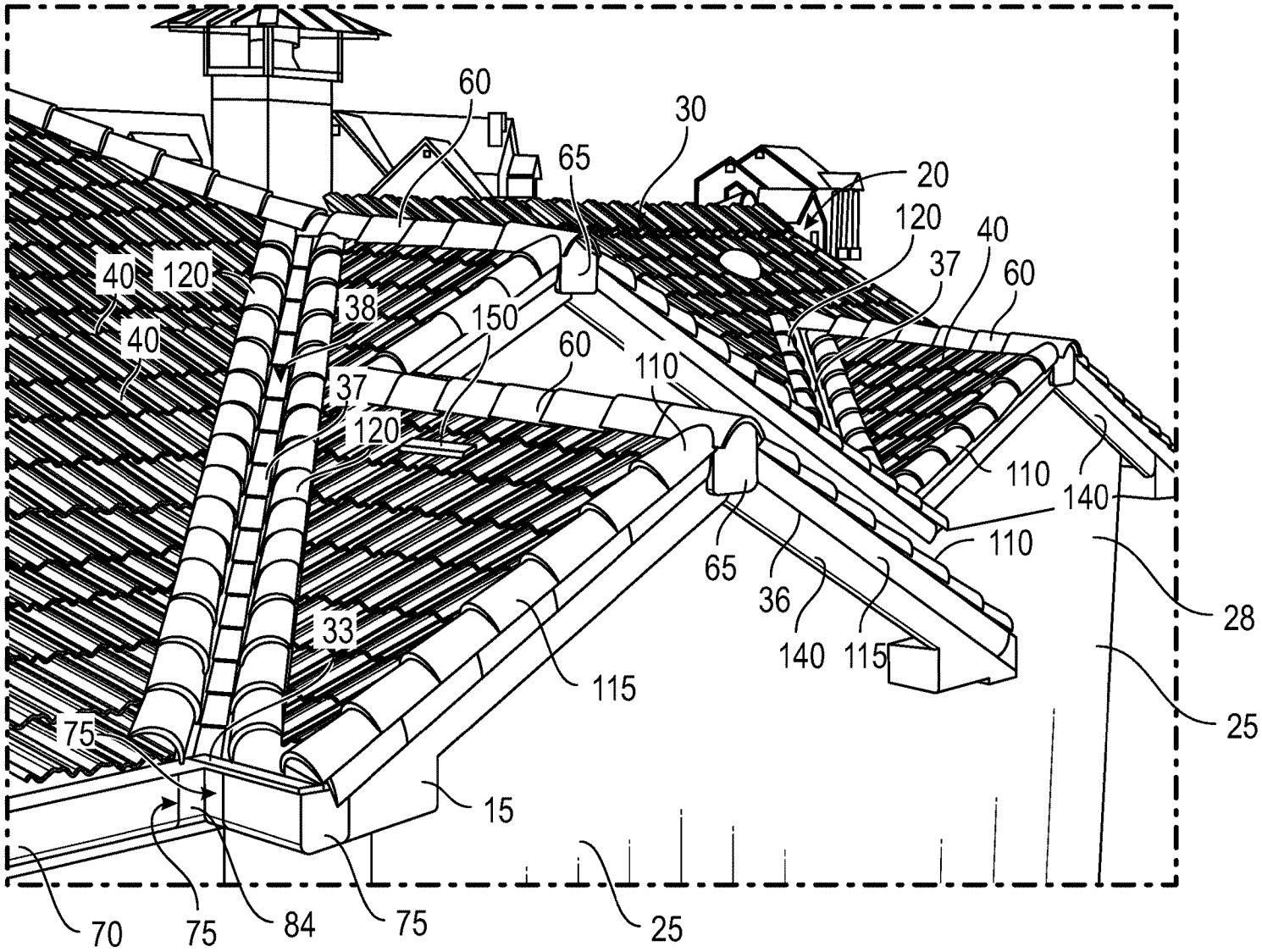
FIG. 5 is a perspective view of a roofing system of the present invention.

Preferably the roofing system 10 further includes one or more gable cap panels 110 adapted for fixing over either the left side 44 or right side 46 of roof panels 40 that are disposed along a sloping edge 36 of the roof 30 (FIG. 5). A cable cap trim panel 115 may also be included to cover the edge 36 of the roof 30. Further, a soffit fascia panel 140 may be fixed under and along the sloping edge 36 of the roof 30.

Figure 7:
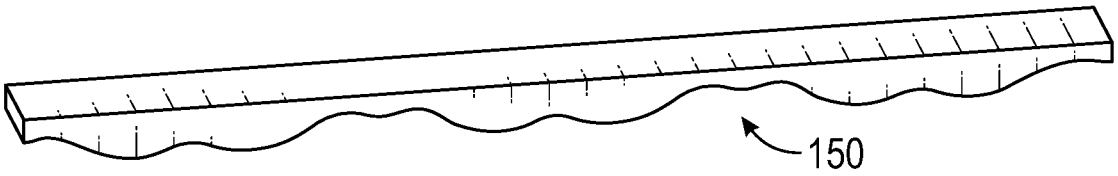
FIG. 7 is a perspective view of a wind breaker of the present invention.
Figure 8:
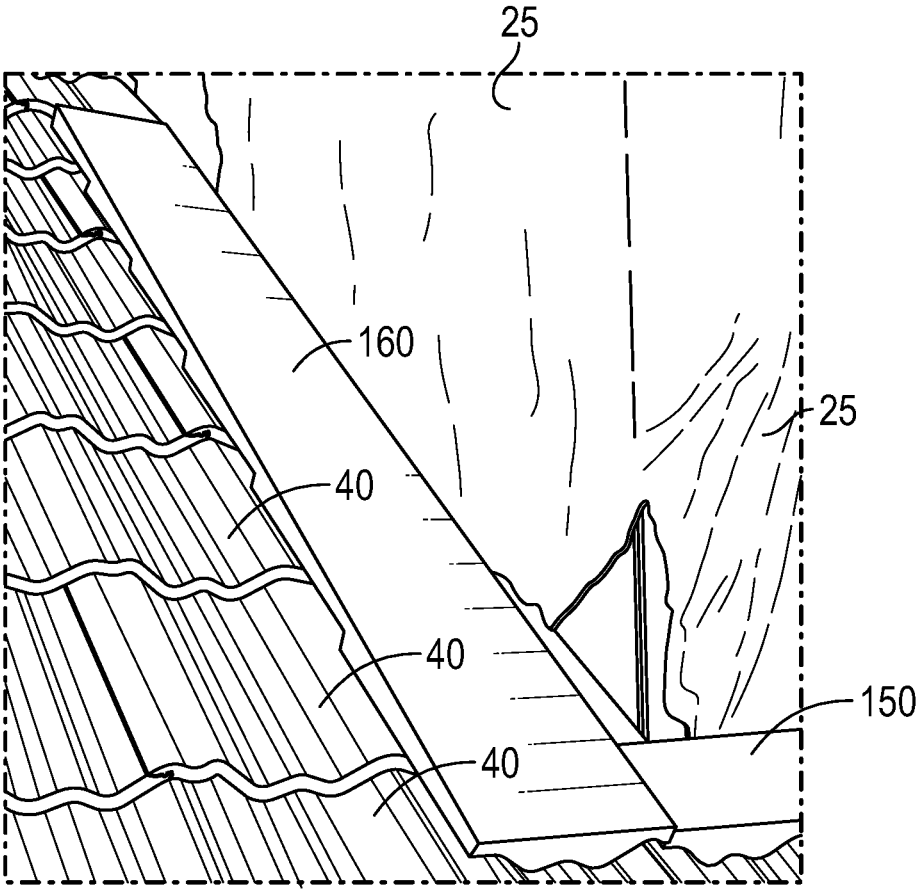
FIG. 8 is a perspective view of a wall flashing shoe of the present invention.

Wind breakers 150 (FIG. 7) may be further included for holding the roof panels 40 down to the roof 30 when the roof 30 experiences a strong wind, for example. And still further, a wall flashing shoe 160 may be included in the roofing system 10 for water proofing the roof 30 adjacent a building wall 25 projecting upwardly from the roof 30.

Figure 6:
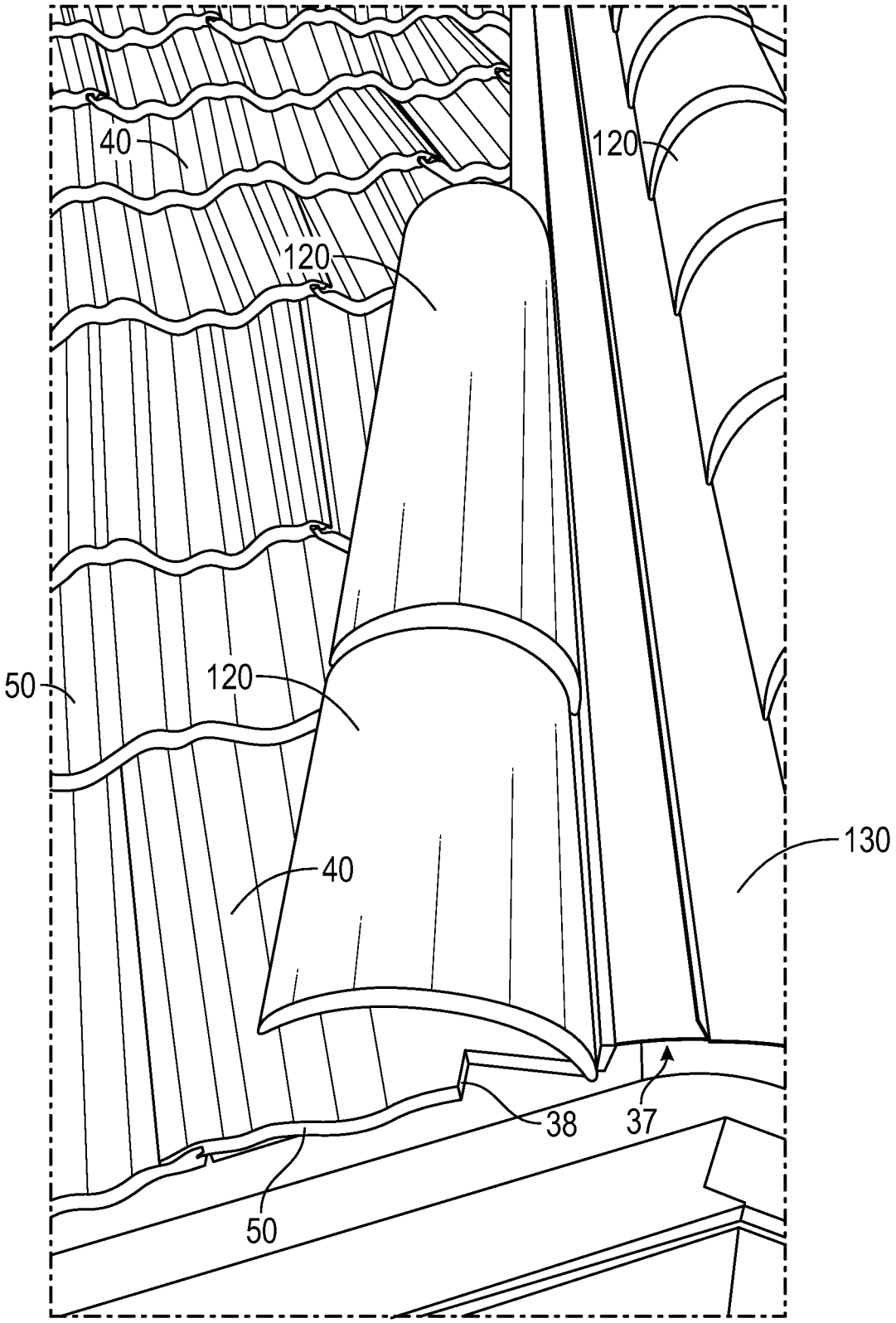
FIG. 6 is a perspective e view of a roof valley having valley cap panels and a water-impervious membrane.

Preferably the roofing system 10 further includes one or more valley cap panels 120 adapted for fixing over either the left side 44, right side 46, for front end 42 of roof panels 40 that are disposed along an edge 38 of a valley 37 of the roof 30 (FIGS. 5 and 6). A cable cap trim panel 115 may also be included to cover the edge 36 of the roof 30. Each valley cap panel 120 is adapted for allowing water to pass thereunder into the valley 37 of the roof 30. Preferably a water-impervious membrane 130 is fixed between adjacent valley caps 120 at a valley 37 of the roof 30.

While a particular form of the invention has been illustrated and described, it will be apparent that various modifications can be made without departing from the spirit and scope of the invention. For example, different styles of roofing panels 40 may be utilized, including S-type roof tiles, slate roof tiles, cedar shake, steel roofs, and the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A roofing system for protecting a roof, the roofing system comprising:

a first roof panel configured to cover a portion of the roof, the first roof panel having a first front end, a first back end, a first left side with a first left-side interlocking structure, a first right side with a first right-side interlocking structure, a first top having a first front flange projecting forward at the first front end, a first bottom, a first interior comprising a first insulating foam material, and a first outer surface comprising a first rigid shell;

a second roof panel configured to cover a portion of the roof, the second roof panel having a second front end, a second back end, a second left side with a second left-side interlocking structure, a second right side with a second right-side interlocking structure, a second top having a second front flange projecting forward at the second front end, a second bottom, a second interior comprising a second insulating foam material, and a second outer surface comprising a second rigid shell; and a gutter panel comprising a third interior comprising a third insulating foam material, and a third outer surface comprising a third rigid shell, the gutter panel being configured to be secured along an edge of the roof and at least partially under the first flange of the first roof panel, wherein the first front end is configured to abut the second back end such that the first front flange overlaps the second top, and wherein the first left side is configured to abut the second right side such that the first left-side interlocking structure interlocks with and overlaps the second right-side interlocking structure.

2. The roofing system of claim 1, wherein the first top comprises a wavy surface having a plurality of peaks and valleys, the plurality of peaks and valleys having a first peak with a first height and a second peak with a second height, wherein the first height is greater than the second height.

3. The roofing system of claim 1, wherein a cross section of the first left-side interlocking structure has an irregular, concave configuration, and wherein a cross section of the second right-side interlocking structure comprises a complementary irregular, concave configuration.

4. The roofing system of claim 2, wherein the first left-side interlocking structure is positioned proximate to the first peak, and wherein the first right-side interlocking structure is positioned proximate to the second peak.

5. The roofing system of claim 1, wherein the gutter panel comprises a mounting slot configured to receive a gutter support board therein, and wherein the gutter support board is configured to be coupled to the roof.

6. The roofing system of claim 1, wherein the gutter panel further comprises a channel configured to receive a substantially U shaped gutter, the channel comprising a water-impervious roofing membrane configured to overlap with a second roofing membrane of a second gutter panel to inhibit water leakage between the gutter panel and the second gutter panel.

7. The roofing system of claim 6, wherein the water-impervious roofing membrane comprises a thermoplastic polyolefin membrane.

8. The roofing system of claim 1, further comprising a corner gutter panel configured to couple the gutter panel to a second gutter panel oriented at an angle with respect to the gutter panel.

9. The roofing system of claim 8, wherein the angle is approximately 90 degrees.

10. The roofing system of claim 6, wherein the gutter panel comprises a downspout aperture traversing the water-impervious roofing membrane, the downspout aperture being configured to couple to a downspout conduit for conveying water away from the roof.

11. The roofing system of claim 2, wherein a lower surface of the first front flange has a shape that corresponds with the wavy surface of the first top.

12. The roofing system of claim 1, wherein at least one of the first left-side interlocking structure and the first right-side interlocking structure is disposed at a downward angle relative to the first bottom.

13. The roofing system of claim 1, wherein the first roof panel is configured such that a distance between the first right side and the first left side is greater than a distance between the first front end and the first back end.

14. The roofing system of claim 2, further comprising a wind breaker panel, the wind breaker panel having an edge with a shape that corresponds with the wavy surface of the first top.

15. A method of assembling a roofing system for protecting a roof, the method comprising:

obtaining a first roof panel configured to cover a portion of the roof, the first roof panel having a first front end, a first back end, a first left side with a first left-side interlocking structure, a first right side with a first right-side interlocking structure, a first top having a first front flange projecting forward at the first front end, a first bottom, a first interior comprising a first insulating foam material, and a first outer surface comprising a first rigid shell;

obtaining a second roof panel configured to cover a portion of the roof, the second roof panel having a second front end, a second back end, a second left side with a second left-side interlocking structure, a second right side with a second right-side interlocking structure, a second top having a second front flange projecting forward at the second front end, a second bottom, a second interior comprising a second insulating foam material, and a second outer surface comprising a second rigid shell;

obtaining a gutter panel having a third interior comprising a third insulating foam material, and a third outer surface comprising a third rigid shell, the gutter panel being configured to be secured along an edge of the roof and at least partially under at least one of the first flange of the first roof panel and the second flange of the second roof panel; and positioning the first roof panel, the second roof panel, and the gutter panel in at least one of the following configurations: (i) a first configuration wherein the first front end abuts the second back end such that the first front flange overlaps the second top, and wherein the gutter panel is positioned at least partially under the second flange; and (ii) a second configuration wherein at least one of the first left-side interlocking structure and the first right-side interlocking structure of the first panel connects to at least one of the second left-side interlocking structure and the second right-side interlocking structure of the second panel, and wherein the gutter panel is positioned at least partially under at least one of the first flange and the second flange.

16. The method of claim 15, further comprising positioning the gutter panel at least partially under both the first flange and the second flange.

17. The method of claim 15, further comprising forming the first roof panel by covering the first insulating foam material with the first rigid shell, wherein the first rigid shell comprises at least one of stucco, plaster, and cement.

18. The method of claim 17, further comprising:

forming a wavy surface on at least one of the first roof panel the second roof panel, and the gutter panel;

obtaining a wind breaker panel having a bottom face with a shape that corresponds with the wavy surface;

aligning at least a portion of the bottom face of the wind breaker panel with the wavy surface; and securing the wind breaker panel to at least one of (i) the first panel, (ii) the second panel, and (iii) the gutter panel.

19. The method of claim 15, further comprising coupling a gutter feature to the gutter panel, the gutter feature comprising at least one of a substantially U-shaped gutter and a downspout.

20. A roofing system comprising:

a first panel comprising a first front end, a first back end having a height that is less than a height of the first front end, a first side with a first interlocking structure, a first top having a first front flange projecting forward at the first front end and a first wavy top surface, a first bottom, a first interior comprising a first insulating foam material, and a first outer surface comprising a first rigid shell;

a second panel comprising a second front end, a second back end, a second side with a second interlocking structure, a second top having a second front flange projecting forward at the second front end and a second wavy top surface, a second bottom, a second interior comprising a second insulating foam material, and a second outer surface comprising a second rigid shell; and a gutter panel comprising a third panel comprising a third interior comprising a third insulating foam material, and a third outer surface comprising a third rigid shell, the third panel being configured to be secured at an edge of the roof, at least partially under the first flange of the first roof panel, and at least partially under the second flange of the second roof panel, a portion of the third panel abutting at least a portion of the first front end and at least a portion of the second front end, the third panel further being configured to channel liquid runoff from each of the first roof panel and the second roof panel, wherein the first interlocking structure is configured to connect to the second interlocking structure so as to connect the first roof panel to the second roof panel in a continuous panel configuration, wherein when the first roof panel and the second roof panel are in the continuous panel configuration, the first wavy top surface and the second wavy top surface form an unbroken pattern of peaks and valleys, and wherein the first interlocking structure connects to the second interlocking structure at a point between a peak and a valley.

* * * * *